US009760047B2

(12) United States Patent
Furusawa

(10) Patent No.: US 9,760,047 B2
(45) Date of Patent: Sep. 12, 2017

(54) FIXATION DEVICE AND IMAGE FORMATION APPARATUS HAVING A REFLECTOR UNIT REFLECTING HEAT FROM A HEAT SOURCE TO BELT

(71) Applicant: Oki Data Corporation, Tokyo (JP)

(72) Inventor: Yasunori Furusawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/240,177

(22) Filed: Aug. 18, 2016

(65) Prior Publication Data

US 2017/0060046 A1 Mar. 2, 2017

(30) Foreign Application Priority Data

Aug. 27, 2015 (JP) ..... 2015-168207

(51) Int. Cl.
*G03G 15/20* (2006.01)
*G03G 15/00* (2006.01)

(52) U.S. Cl.
CPC ..... *G03G 15/2053* (2013.01); *G03G 15/652* (2013.01); *G03G 2215/2032* (2013.01)

(58) Field of Classification Search
CPC ..... G03G 15/2007; G03G 15/2017; G03G 15/2053
USPC ..... 399/329, 336
See application file for complete search history.

(56) References Cited

U.S. PATENT DOCUMENTS 8,909,118 B2 * 12/2014 Seol et al. ..... G03G 15/2053 399/329
9,031,485 B2 * 5/2015 Ishii et al. ..... G03G 15/2053 399/329
9,037,058 B2 * 5/2015 Iwata ..... G03G 15/2053 399/329

FOREIGN PATENT DOCUMENTS

JP 2015-087624 A 5/2015

* cited by examiner

*Primary Examiner* — William J Royer
(74) *Attorney, Agent, or Firm* — Metrolexis Law Group, PLLC

(57) ABSTRACT

A fixation device includes a fixation belt, a heat source that heats the fixation belt, and a reflector unit that reflects heat from the heat source to the belt. The reflector unit includes a reflective member that reflects the heat from the heat source, and a radiation member that is disposed on an opposite side to a side of the reflective member facing the heat source, and that radiates heat of the reflective member.

13 Claims, 8 Drawing Sheets

Fig. 3A
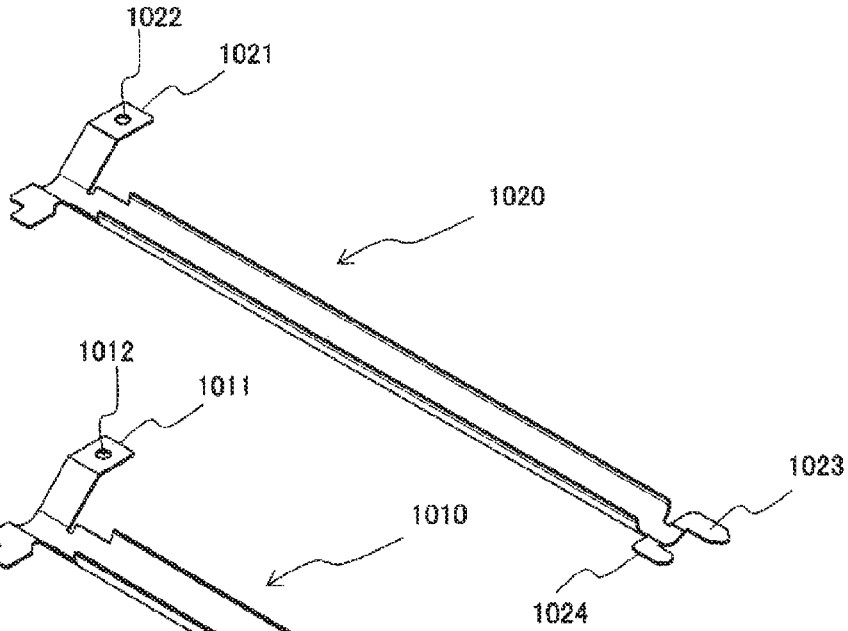
Fig. 3B
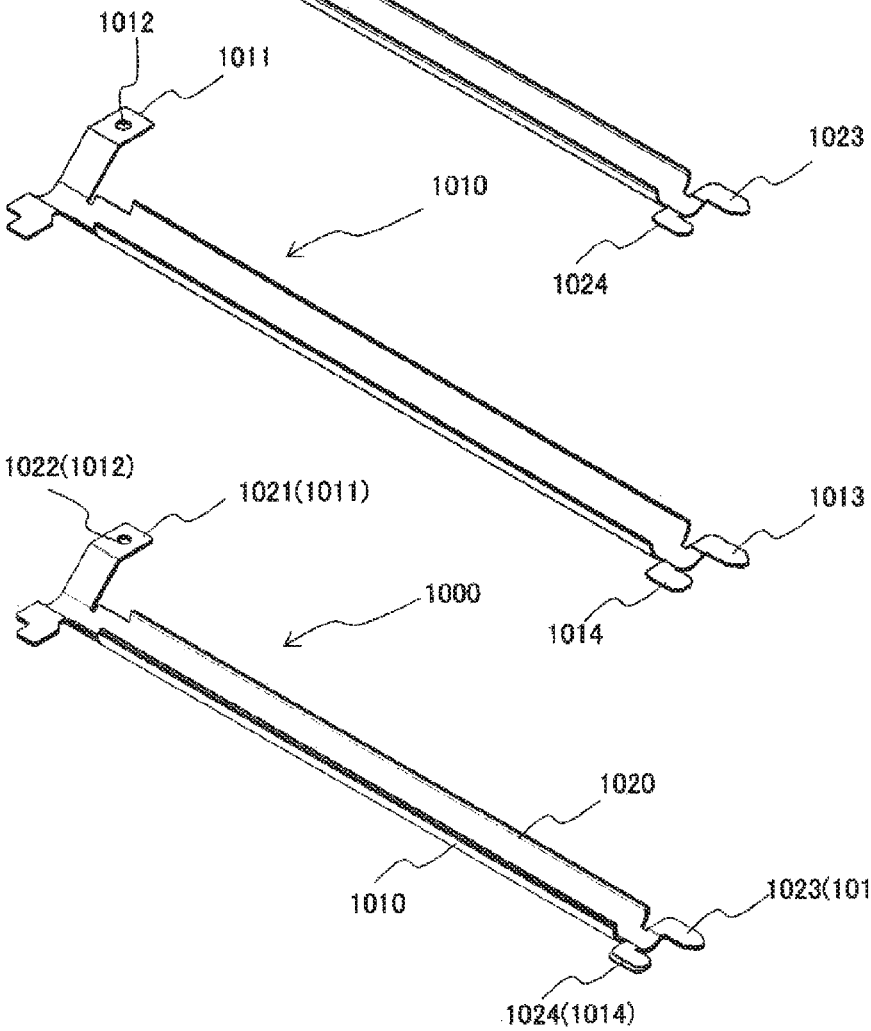
Fig. 3C

FIXATION DEVICE AND IMAGE FORMATION APPARATUS HAVING A REFLECTOR UNIT REFLECTING HEAT FROM A HEAT SOURCE TO BELT

CROSS REFERENCE TO RELATED APPLICATIONS

This application claims priority based on 35 USC 119 from prior Japanese Patent Application No. 2015-0168207 filed on Aug. 27, 2015, entitled "FIXATION DEVICE AND IMAGE FORMATION APPARATUS", the entire contents of which are incorporated herein by reference.

BACKGROUND OF THE INVENTION

1. Field of the Invention

This disclosure relates to a fixation device and an image formation apparatus, and is applicable to, for instance, an electrophotographic image formation apparatus that fixes a transferred toner image to a medium by heat and pressure.

2. Description of Related Art

In the related art, electrophotographic image formation apparatuses are known which fix a development agent image (a toner image) onto the surface of a medium (for instance, a paper sheet) to form an image.

A fixation device in the related art is described, for instance, in Japanese Patent Application Publication No. 2015-87624 (JP-A 2015-87624). The fixation device described in JP-A 2015-87624 includes a fixation belt, a halogen lamp as a heat source that heats the fixation belt, and a roller that rotates the fixation belt and forms a nip at which a medium is nipped. In addition, the fixation device described in JP-A 2015-87624 also includes a reflective plate (a reflector unit) that reflects the heat from the heat source to the fixation belt. The fixation device in the related art is provided with the reflective plate to promote an efficient heating of the fixation belt.

SUMMARY OF THE INVENTION

However, in the fixation device in the related art, the reflective plate at a predetermined temperature or higher tends to decrease (deteriorate) its reflective performance because the surface of the reflective plate changes.

An object of an embodiment of the invention is to provide a fixation device and an image formation apparatus capable of suppressing a decrease in the reflective performance of a reflector unit that reflects heat from a heat source.

A first aspect of the invention is a fixation device that includes: a fixation belt; a heat source that heats the fixation belt; and a reflector unit that reflects heat from the heat source to the belt. The reflector unit includes a reflective member that reflects the heat from the heat source, and a radiation member that is disposed on an opposite side to a side of the reflective member facing the heat source, and that radiates heat of the reflective member.

A second aspect of the invention is an image formation apparatus that includes the fixation device according to the first aspect that fixes a development agent image formed on a medium.

According to the aspects of the invention, it is possible to suppress a decrease in the reflective performance of the reflector unit that reflects the heat from a heat source.

BRIEF DESCRIPTION OF THE DRAWINGS

FIGS. 3A to 3C are each an illustration of the configuration of a first reflector unit according to the embodiment;

DETAILED DESCRIPTION OF EMBODIMENTS

Figure 1:
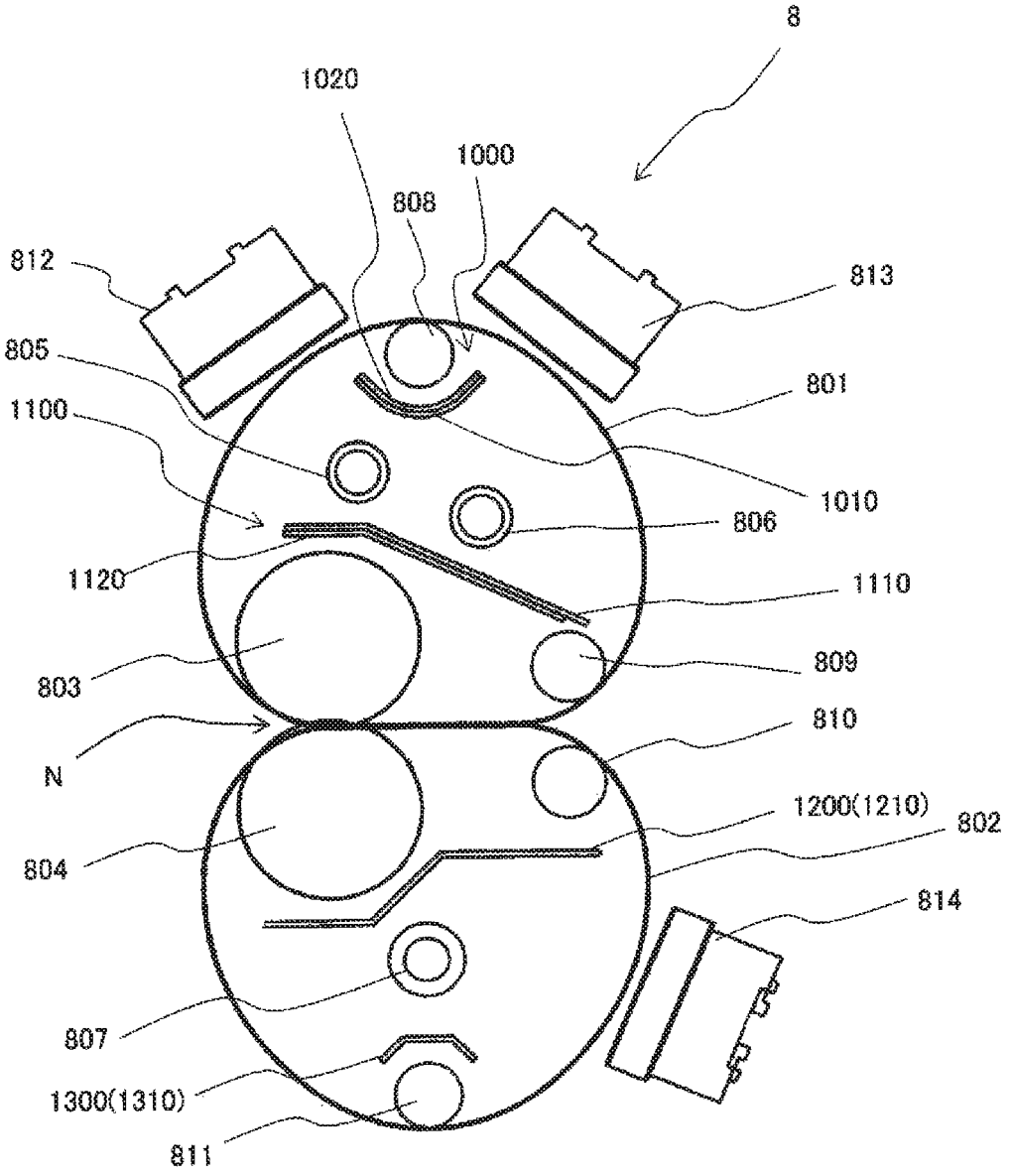
FIG. 1 is a schematic sectional view of a fixation device according to an embodiment of the invention.

Descriptions are provided hereinbelow for embodiments based on the drawings. In the respective drawings referenced herein, the same constituents are designated by the same reference numerals and any duplicate explanation concerning the same constituents is omitted. All of the drawings are provided to illustrate the respective examples only.

(A) First Embodiment

Hereinafter, a first embodiment of a fixation device and an image formation apparatus of the invention is described in detail with reference to the drawings. In the embodiment, a case is illustrated where the invention is applied to an electrophotographic color printer.

(A-1) Configuration and Operation of the First Embodiment

Figure 2:
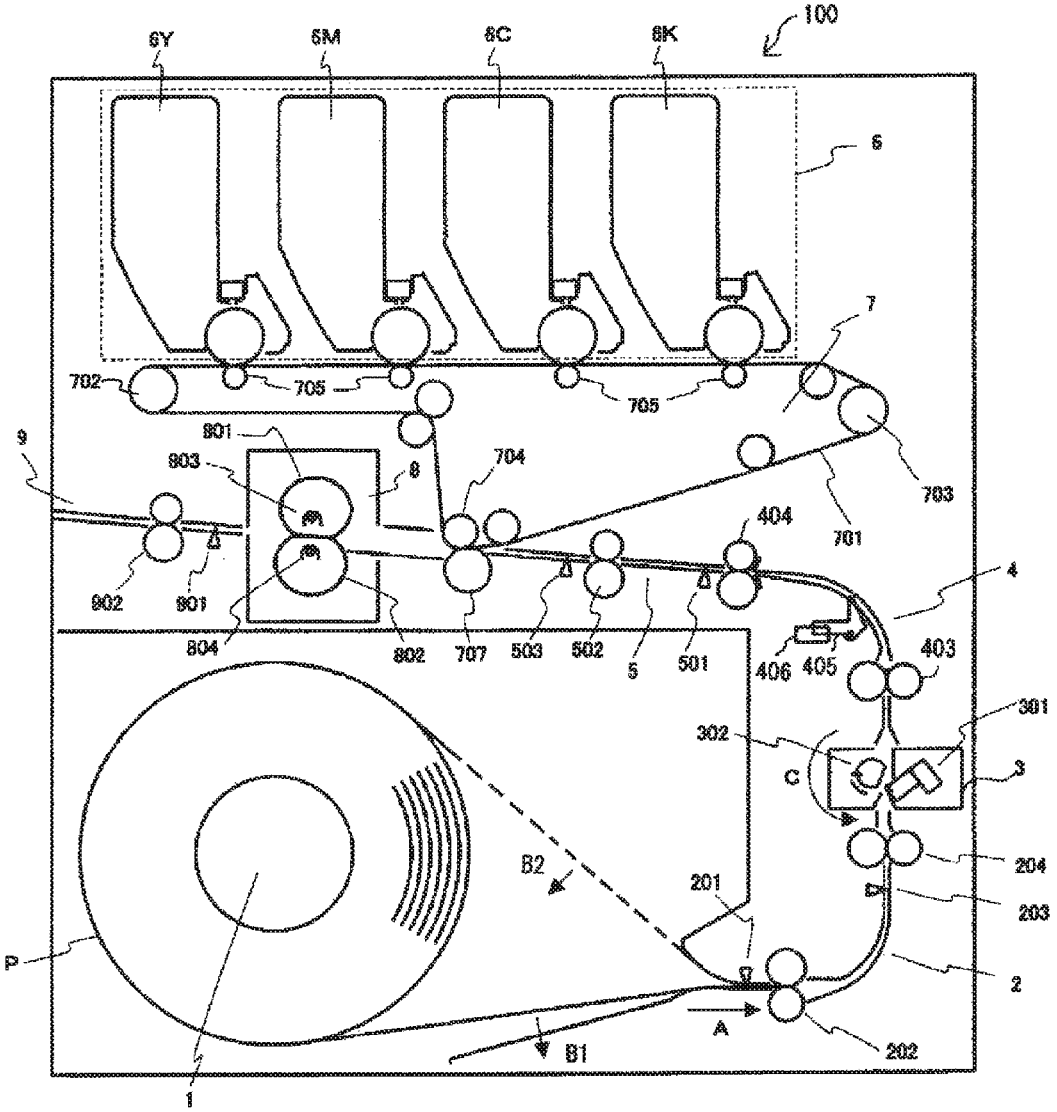
FIG. 2 is a schematic sectional view of an image formation apparatus according to the embodiment.

FIG. 2 is a schematic configuration diagram illustrating the internal configuration of an image formation apparatus according to the embodiment.

Image formation apparatus 100 according to the embodiment mainly includes medium holder 1, paper feed conveyance path 2, medium cutter 3, medium slack control conveyance path 4, write timing adjustment conveyance path 5, image formation unit 6, intermediate transfer belt unit 7, fixation device 8, and discharge conveyance path 9.

In the embodiment, a case is illustrated where the medium is a continuous form paper (rolled paper) which is wound in a roll.

Medium holder 1 is inserted, for instance, in a paper tube for paper sheet P which is a continuous form roll paper like rolled paper, and holds paper sheet P in a freely rotatable manner. Paper sheet P may allow double-sided printing or single-sided printing. In addition, one side of paper sheet P comprises a releasable sheet (a peelable sheet) to form a label(s) or a label sheet(s) on which an image is to be printed. Paper sheet P held in medium holder 1 may set in first feed roller pair 202, for instance, as indicated by the solid line of FIG. 2, and the side of paper sheet P in the direction of arrow B1 (that is, the outer circumferential side of roll paper sheet P) may be set to the printing side. Alternatively, paper sheet P may be set in the first feed roller pair 202, for instance, as indicated by the dashed line of FIG.

2, and the side of paper sheet P in the direction of arrow B2 (that is, the inner circumferential side of roll paper sheet P) may be set to the printing side.

Paper feed conveyance path 2 is a component that feeds paper sheet P from medium holder 1. Paper feed conveyance path 2 includes entry sensor 201, first feed roller pair 202, medium end detection sensor 203, and second feed roller pair 204.

When entry sensor 201 near medium holder 1 of paper feed conveyance path 2 detects that the front end of paper sheet P from medium holder 1 is inserted, first feed roller pair 202 driven by, for instance, a drive unit feeds paper sheet P in conveyance direction A. Medium end detection sensor 203 detects the front end position of the fed paper sheet P, and first feed roller pair 202 sends paper sheet P to second feed roller pair 204.

On the downstream side of second feed roller pair 204, medium cutter 3 is disposed that cuts paper sheet P at any position. Medium cutter 3 includes fixed blade 301 and rotary blade 302 that is rotated by, for instance, a drive unit. Rotary blade 302 is rotated in the direction of arrow C with respect to fixed blade 301, and fixed blade 301 and rotary blade 302 thereby nip and cut paper sheet P.

Medium slack control conveyance path 4 detects the position of moving paper sheet P, and provides slack to paper sheet P according to the position of the paper sheet P. Medium slack control conveyance path 4 includes slack control roller pair 403, conveyance roller pair 404, slack detection lever 405 as a slack detection member, and moving position detector 406.

Write timing adjustment conveyance path 5 is disposed adjacent to medium slack control conveyance path 4, and is a component that adjusts the timing of feeding paper sheet P to secondary transfer roller 707 of intermediate transfer belt unit 7. Write timing adjustment conveyance path 5 includes first medium front end detection sensor 501, timing adjustment roller pair 502, and second medium front end detection sensor 503.

In write timing adjustment conveyance path 5, first medium front end detection sensor 501 detects the front end of paper sheet P which is conveyed from conveyance roller pair 404, and second medium front end detection sensor 503 detects the front end of paper sheet P which is conveyed from timing adjustment roller pair 502. In addition, based on the sensor information from first medium front end detection sensor 501 and second medium front end detection sensor 503, and information on a rotational operation state of intermediate transfer belt unit 7, a synchronization is established so that a development agent image formed on intermediate transfer belt 701 of intermediate transfer belt unit 7 is transferred to a predetermined position on the surface of paper sheet P, and timing adjustment roller pair 502 delivers paper sheet P.

Image formation unit 6 forms a development agent image (a toner image) according to print data on intermediate transfer belt 701 of intermediate transfer belt unit 7. Image formation apparatus 100 according to the embodiment is the case of a color printer based on an electrophotographic process. Therefore, in image formation unit 6 of the embodiment, an upper portion of intermediate transfer belt unit 7 is equipped with image formation units 6Y, 6M, 6C, 6K that form respective images of development agents (toners) with different colors, such as yellow (Y), magenta (M), cyan (C) and black (K).

Image formation units 6Y, 6M, 6C, 6K form respective development agent images with different colors of development agents in order on intermediate transfer belt 701 which rotates counterclockwise in FIG. 2.

Intermediate transfer belt unit 7 receives transferred development agent images which are formed by image formation unit 6 (image formation units 6Y 6M, 6C, 6K), and further transfers the development agent images to paper sheet P while establishing a synchronization in the write timing adjustment conveyance path 5.

Intermediate transfer belt unit 7 includes drive roller 702 driven by, for instance, a drive unit, tension roller 703 that applies tension to intermediate transfer belt 701 by a bias member such as a coil spring, secondary transfer backup roller 704 that faces secondary transfer roller 707 and that transfers a development agent image in paper sheet P, and intermediate transfer belt 701 stretched on various rollers.

Intermediate transfer belt unit 7 also includes primary transfer rollers 705 that each applies a predetermined voltage in order to transfer respective development agent images formed by image formation units 6Y, 6M, 6C, 6K onto the surface of intermediate transfer belt 701 at positions facing image formation units 6Y, 6M, 6C, 6K of image formation unit 6.

Discharge conveyance path 9 is disposed adjacent to fixation device 8, and includes conveyance detection sensor 901, and conveyance roller pair 902. Conveyance detection sensor 901 detects the passage of paper sheet P on which an image is fixed by fixation device 8, and conveyance roller pair 902 conveys paper sheet P that has the image fixed thereon to discharge conveyance path 9 to discharge paper sheet P to the outside.

Fixation device 8 applies heat and pressure to a toner image (a development agent image) on paper sheet P sent out from secondary transfer roller 707 and secondary transfer backup roller 704 of intermediate transfer belt unit 7, and fuses the toner image to fix the image to paper sheet P.

FIG. 1 is a schematic sectional view of fixation device 8.

Fixation device 8 includes roller drive 803 as a fixing roller, and roller pressure 804 as a pressure roller. Roller drive 803 and roller pressure 804 are disposed to face each other. Roller pressure 804 is biased in the direction to roller drive 803, and forms a nip portion N between roller pressure 804 and roller drive 803. Nip portion N is a contact portion between roller drive 803 and roller pressure 804, and is also called a fixing nip portion. Paper sheet P from image formation unit 6 passes through nip portion N and is discharged. At this point, roller drive 803 and roller pressure 804 apply heat and pressure to a toner image, which has not been fixed on paper sheet P, in nip portion N, and fixes the toner image to paper sheet P.

Each member of roller drive 803 and roller pressure 804 is mounted on the frame of fixation device 8.

As illustrated in FIG. 1, a fixation belt in an endless form or belt 801 as a first belt is disposed on the outside of roller drive 803. Also, a press belt in an endless form or belt 802 as a second belt is disposed on the outside of roller pressure 804.

That is, in nip portion N, belt 801 and belt 802 are nipped between roller drive 803 and roller pressure 804. In other words, roller drive 803 and roller pressure 804 are brought into contact under pressure via belt 801 and belt 802.

Two roller supports 808, 809 are disposed in belt 801 as support members (stretch members). That is, belt 801 is stretched by roller drive 803 and roller supports 808, 809. As illustrated in FIG. 1, in belt 801, roller support 808 is disposed on the upper side, and roller drive 803 and roller support 809 are disposed on the lower side.

Belt 801 moves in a medium conveyance direction in which paper sheet P is conveyed, and applies heat to a toner image, which has not been fixed on the paper sheet P being conveyed. Specifically, belt 801 is rotatably disposed, and moves rotationally in a predetermined rotational direction. Belt 801 rotates (moves) along with the rotation of roller drive 803. Belt 802 is driven to rotate (move) by belt 801 due to a frictional force with belt 801. Specifically, belt 802 rotates (moves) in a predetermined direction along with the rotation (movement) of belt 801. In addition, roller pressure 804 inscribed in belt 802 also rotates along with the rotation (movement) of belt 802. Belts 801, 802 extend in a longitudinal direction (a perpendicular direction when seen with the view of FIG. 1) perpendicular to the medium conveyance direction. Belts 801, 802 have elasticity.

Two halogen lamps 805, 806 are disposed inside belt 801 as heat sources for heating belt 801. In addition, one halogen lamp 807 is disposed inside belt 802.

In fixation device 8, more heat sources are disposed in belt 801 as the fixation belt mainly for heating a toner image transferred to the upper side of paper sheet P. However, the number and types of heat sources disposed in each belt are not limited.

Similarly, two roller supports 810, 811 are disposed in belt 802 as support members (stretch members). That is, belt 802 is stretched by roller pressure 804 and roller supports 810, 811. As illustrated in FIG. 1, in belt 802, roller pressure 804 and roller support 810 are disposed on the upper side (side of nip portion N), and roller support 811 is disposed on the lower side.

Inside belt 801, two reflector units 1000, 1100 are disposed that reflect heat (or light) from halogen lamps 805, 806 to belt 801. Reflector unit 1000 is disposed above halogen lamps 805, 806 and between halogen lamps 805, 806 and roller support 808. In addition, reflector unit 1100 is disposed below halogen lamps 805, 806 and between halogen lamps 805, 806 and the lower members (roller drive 803 and roller support 809). In other words, two reflector units 1000, 1100 are disposed so as to face halogen lamps 805, 806. That is, reflector units 1000, 1100 reflect the heat (or light) of halogen lamps 805, 806 to increase the efficiency of heating belt 801 and to suppress any direct conduction of the heat (radiant heat) of halogen lamps 805, 806 to other members (roller drive 803, roller supports 808, 809).

In addition, as illustrated in FIG. 1, inside belt 802, two reflector units 1200, 1300 are disposed that reflect the heat (or light) from halogen lamp 807 to belt 802. Reflector unit 1200 (reflector 1210) is disposed above halogen lamp 807 so as to cover roller pressure 804 and roller support 810. In addition, reflector unit 1300 (reflector 1310) is disposed below halogen lamp 807 and between halogen lamp 807 and roller support 811 so as to cover roller support 811. In other words, two reflector units 1200, 1300 are disposed so as to face halogen lamp 807.

Two thermostats 812, 813 are disposed around belt 801. In addition, one thermostat 814 is disposed around belt 802.

Next, the detailed configuration of reflector units 1000 and 1100 is described In reflector unit 1000, the side facing halogen lamps 805, 806 is provided with reflector 1010 as a reflective member (reflective plate) by which the heat (or light) from halogen lamps 805, 806 is likely to be reflected. Also, in reflector unit 1000, the opposite side (the side facing roller support 808) to the side facing halogen lamps 805, 806 is provided with radiator 1020 as a radiation member (radiation plate) for radiating (exhausting) the heat of reflector 1010.

Similarly, also in reflector unit 1100, the side facing halogen lamp 807 is provided with reflector 1110 by which the heat (or light) from halogen lamp 807 is likely to be reflected. Also, in reflector unit 1100, the opposite side (the side facing roller support 811) to the side facing halogen lamp 807 is provided with radiator 1120 for radiating (exhausting) the heat of reflector 1110.

As illustrated in FIG. 1, reflector 1010, 1110 and radiator 1020, 1120 are in substantially the same shape when viewed in a substantially vertical direction. One side of reflector 1010, 1110 and one side of radiator 1020, 1120 are formed/disposed to be in contact with each other over their entire sides. Reflector 1010, 1110 and radiator 1020, 1120 may be bonded together at their contact surfaces by an adhesive or the like, but may be just stacked on and fixed to each other without using an adhesive. In the latter case, reflector 1010, 1110 may be less likely to be deformed.

The material for reflectors 1010, 1110 is not limited as long as the material has a property that allows heat (or light) to be easily reflected. As a material for reflectors 1010, 1110, for instance, a plate-shaped aluminum with a silver deposited surface (the side facing the heat source) may be used. For instance, MIRO-SILVER (a material of aluminum with a silver deposited surface) manufactured by Alanod has a reflectance of 98% which exhibits excellent reflective characteristics and thus is a suitable material for reflectors 1010, 1110. The melting point temperature of aluminum is approximately 660° C. When reflectors 1010, 1110 are excessively heated to near the melting point temperature of reflectors 1010, 1110 by halogen lamps 805, 806, the reflective performance may be reduced due to a modification or the like. Specifically, for instance, as the temperature of reflectors 1010, 1110 increases, the surfaces (the sides on which silver is deposited) may be discolored and the reflective performance (reflectance) may decrease.

Thus, in the embodiment, reflector unit 1000, 1100 is formed by stacking radiator 1020, 1120 on reflector 1010, 1110, thereby suppressing an increase in the temperature of reflector 1010, 1110.

For radiators 1020, 1120, it is desirable to use a material having a high thermal conductivity and a higher heat resistance (for instance, a higher melting point temperature) than reflectors 1010, 1110. Use of such a material may surely provide the heat radiation function to radiators 1020, 1120. Also, a metal material having a high heat resistance (a metal material having a melting point temperature at least higher than that of reflectors 1010, 1110) is used for radiators 1020, 1120, and thereby radiators 1020, 1120 may support reflectors 1010, 1110 and exhibit the function of suppressing deformation of reflectors 1010, 1110 at a high temperature. For radiators 1020, 1120, a metal material such as a stainless steel (for instance, SUS304) for instance is applicable. Since stainless steel (SUS) has a higher stiffness and a softening temperature (a melting point temperature) than aluminum, SUS is preferred as the material applied to radiators 1020, 1120. It is to be noted that since the melting point temperature of SUS is higher than or equal to 1400° C. (equals 1.5 or more times higher than the melting point temperature of aluminum), stainless steel is preferred as a material for radiators 1020, 1120. Although the plate thickness of reflectors 1010, 1110 and radiators 1020, 1120 is not limited, the plate thickness is preferably about 0.5 mm, for instance.

Next, an example of a specific shape of reflector units 1000, 1100 is described with reference to FIGS. 3A to 3C and FIGS. 4A to 4C.

FIGS. 3A to 3C are each an explanatory diagram illustrating the structure of reflector unit 1000. FIG. 3A is a perspective view of radiator 1020 which is dismounted. FIG. 3B is a perspective view of reflector 1010 which is dismounted. FIG. 3C is a perspective view of reflector 1010 and radiator 1020 which are stacked on each other (reflector unit 1000 is formed).

As illustrated in FIG. 3A, one end of radiator 1020 is provided with fixture portion 1021 for fixing frame 815 (See FIG. 6A) of a later-described fixation device 8 with a screw. Fixture portion 1021 is provided with a later-described screw hole 1022 for allowing screw 816 (See FIG. 5) to pass through. Also, the other end (the opposite end to fixture portion 1021) of radiator 1020 is provided with engagement portions 1023, 1024 (projecting portions of a plate surface) for engaging with frame 815 of a later-described fixation device 8. It is to be noted that the specific shape of each engagement portion in reflector unit 1000 (reflector 1010 and radiator 1020) is not limited as long as the shape corresponds to the structure of frame 815 of fixation device 8. As illustrated in FIG. 3B, one end of reflector 1010 is also provided with a later-described fixture portion 1011 for fixing frame 815 of the later-described fixation device 8 with screw 816. The other end of reflector 1010 is provided with engagement portions 1013, 1014 for engaging with frame 815 of the later-described fixation device 8. Also, fixture portion 1011 is provided with a later-described screw hole 1012 for allowing screw 816 to pass through. Since radiator 1020 and reflector 1010 have to be configured to be stacked on each other, as illustrated in FIG. 3C, corresponding portions of radiator 1020 and reflector 1010 are formed in such shapes that radiator 1020 and reflector 1010 are in contact with each other over their entire sides when being stacked on each other.

Figure 4A:
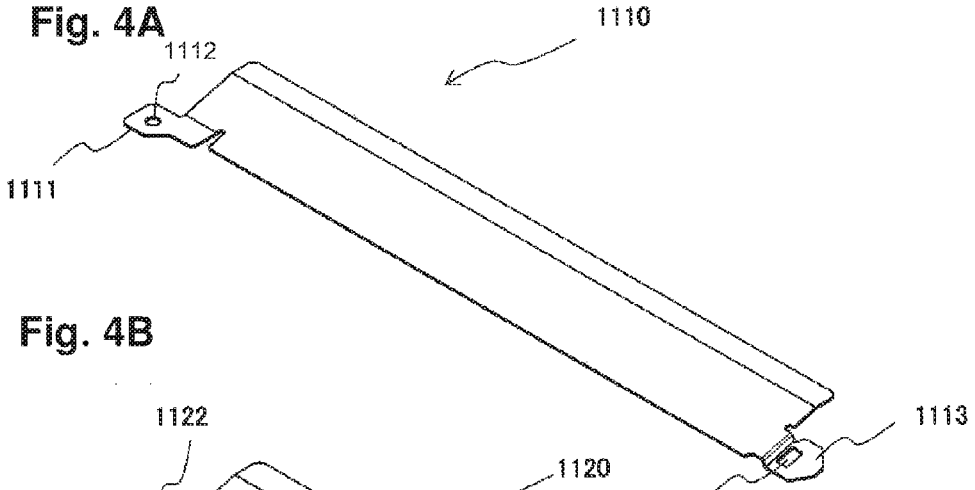
FIGS. 4A to 4C are each an illustration of the configuration of a second reflector unit according to the embodiment.
Figure 4B:
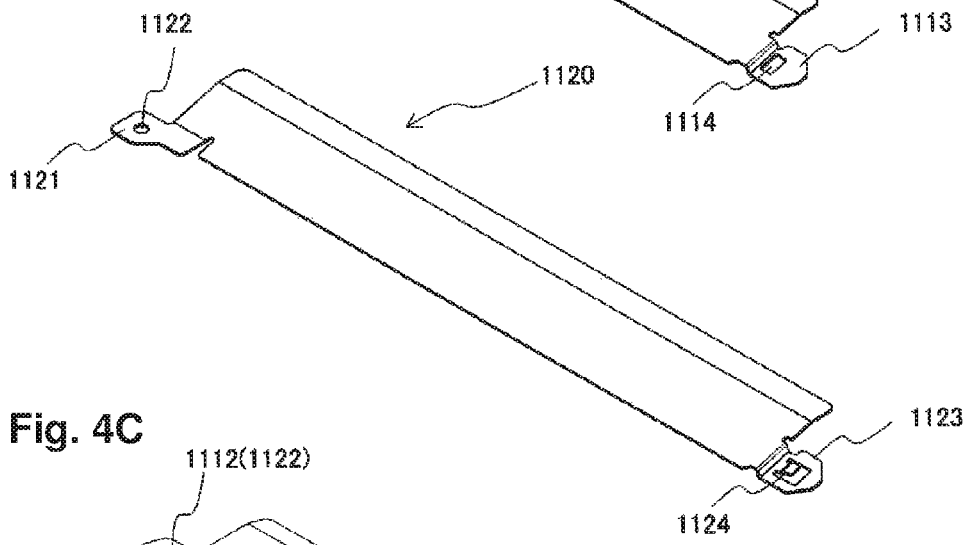
Figure 4C:
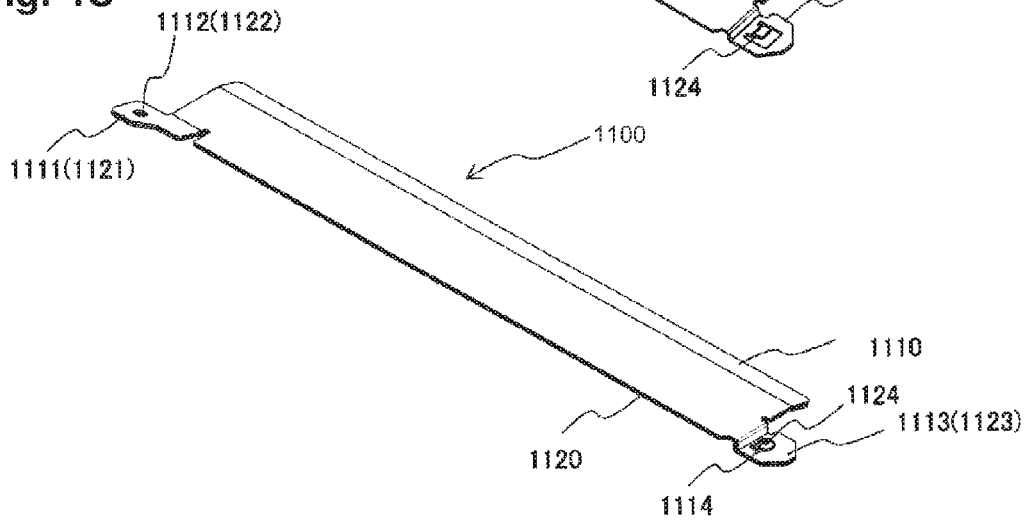

FIGS. 4A to 4C are each an explanatory diagram illustrating the structure of reflector unit 1100. FIG. 4A is a perspective view of reflector 1110 which is dismounted. FIG. 4B is a perspective view of radiator 1120 which is dismounted. FIG. 4C is a perspective view of reflector 1110 and radiator 1120 which are stacked on each other (reflector unit 1100 is formed).

As illustrated in FIG. 4A, one end of reflector 1110 is provided with fixture portion 1111 for fixing frame 815 of a later-described fixation device 8 with a screw. Fixture portion 1111 is provided with a later-described screw hole 1112 for allowing screw 817 (See FIG. 7) to pass through. Also, the other end (the opposite end to fixture portion 1111) of reflector 1110 is provided with engagement portion 1113 (the projecting portion of a plate surface) for engaging with frame 815 of a later-described fixation device 8. It is to be noted that the specific shape of each engagement portion in reflector unit 1100 (reflector 1110 and radiator 1120) is not limited as long as the shape corresponds to the structure of frame 815 of fixation device 8. As illustrated in FIG. 4B, one end of radiator 1120 is also provided with a later-described fixture portion 1121 for fixing frame 815 of the later-described fixation device 8 with screw 817. The other end of radiator 1120 is provided with engagement portion 1123 for engaging with frame 815 of the later-described fixation device 8. Also, fixture portion 1121 is provided with a later-described screw hole 1122 for allowing screw 817 to pass through. Since reflector 1110 and radiator 1120 have to be configured to be stacked on each other as illustrated in FIG. 4C, corresponding portions of reflector 1110 and radiator 1120 are formed in such shapes that reflector 1110 and radiator 1120 are be in contact with each other over their entire sides when being stacked on each other.

Also, as illustrated in FIG. 4A, reflector 1110 is provided at engagement portion 1113 with engagement hole 1114 for engaging with radiator 1120. Furthermore, as illustrated in FIG. 4B, radiator 1120 is provided at engagement portion 1123 with engagement projection 1124 to be inserted in engagement hole 1114 of reflector 1110 for engaging with reflector 1110. Engagement projection 1124 is formed in an inverted L-shape projecting upward from engagement portion 1123, and the inverted L-shape is insertable in/engageable with engagement hole 1114 when reflector 1110 and radiator 1120 are stacked on each other. That is, in reflector unit 1100, engagement hole 1114 and engagement projection 1124 are engaged with each other, thereby making it easy to maintain a state (a state of intimate contact) where reflector 1110 and radiator 1120 are in contact with each other.

Next, the configuration for mounting reflector units 1000, 1100 on fixation device 8 (frame 815) is described with reference to FIGS. 5 to 9.

Figure 5:
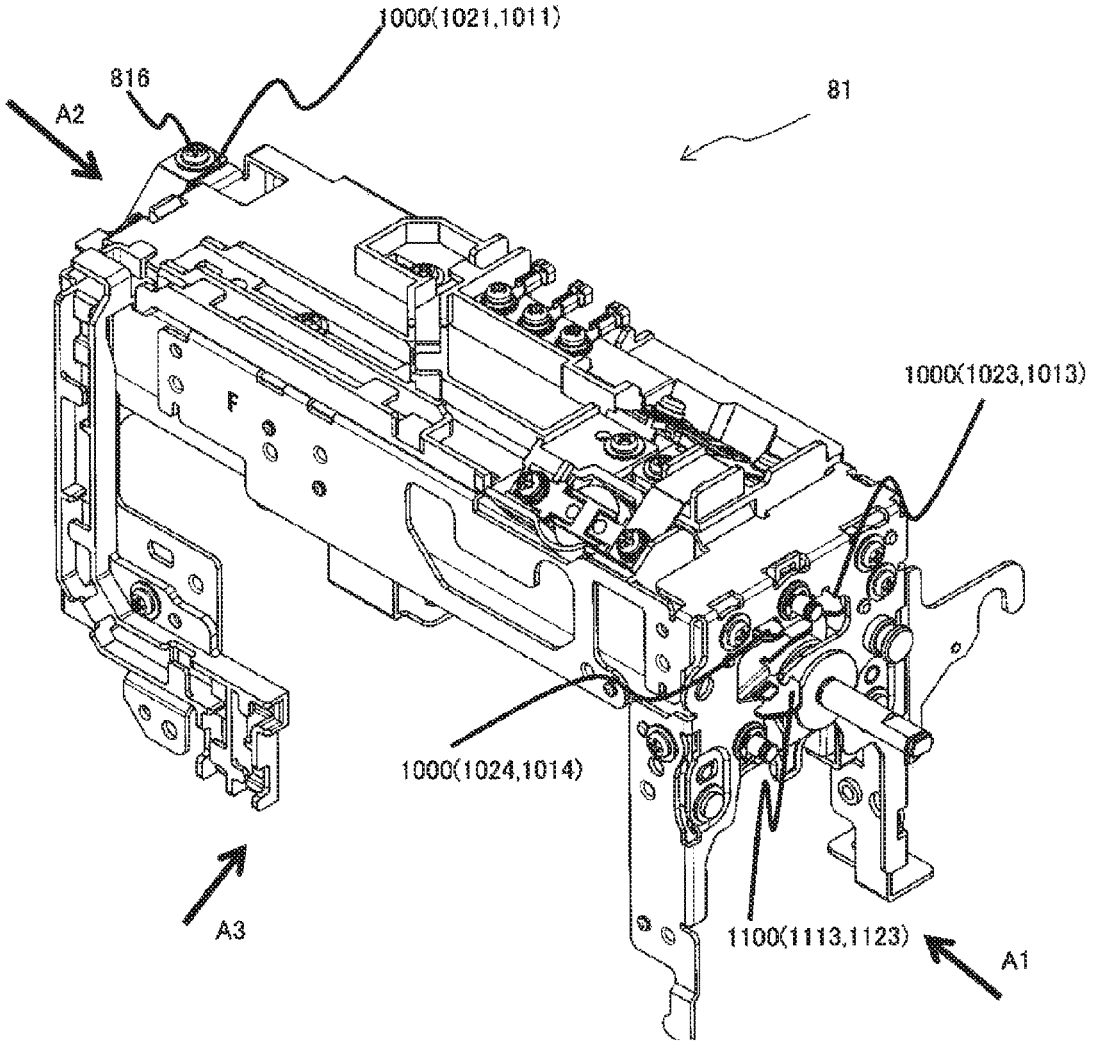
FIG. 5 is a perspective view of an upper-side unit included in the fixation device according to the embodiment.

FIG. 5 is a perspective view of upper-side unit (Assy) 81 of fixation device 8, which is dismounted. It is to be noted that fixation device 8 also includes a lower-side unit (Assy) which is not illustrated.

As illustrated in FIG. 5, in unit 81, each component is attached to frame (case) 815. As illustrated in FIG. 5, reflector units 1000, 1100 are also attached to frame 815.

In FIG. 5, arrow A1 indicates the lateral side in which reflector units 1000, 1100 are engaged in unit 81 (frame 815). Also, arrow A2 shown in FIG. 5 indicates the lateral side in which reflector units 1000, 1100 are screwed in frame 815.

Figure 6A:
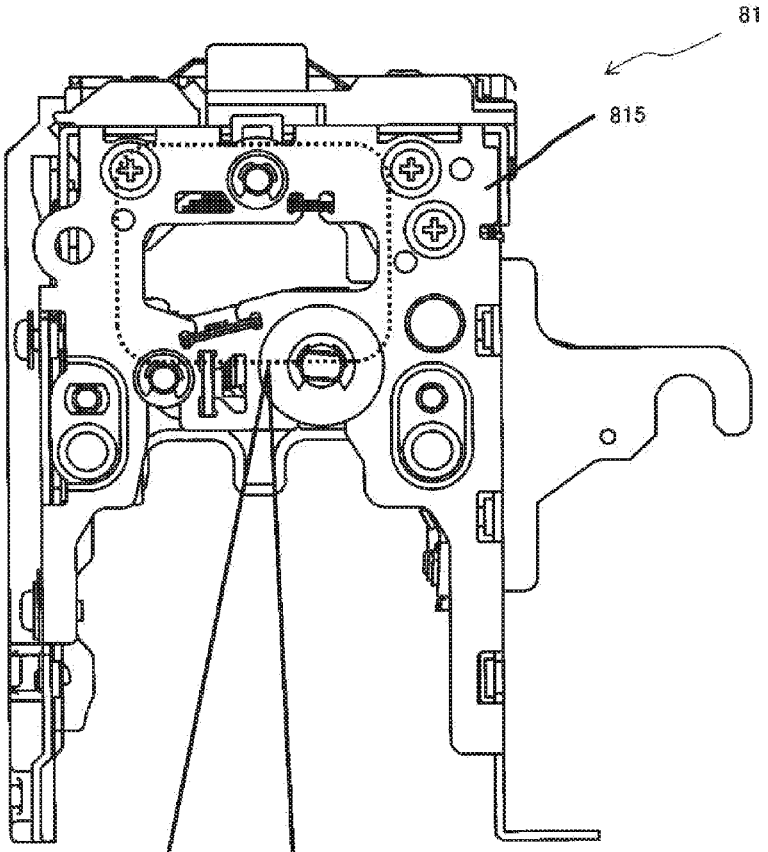
FIG. 6A is a side view (part 1) of a unit (frame) according to the embodiment.
Figure 6B:
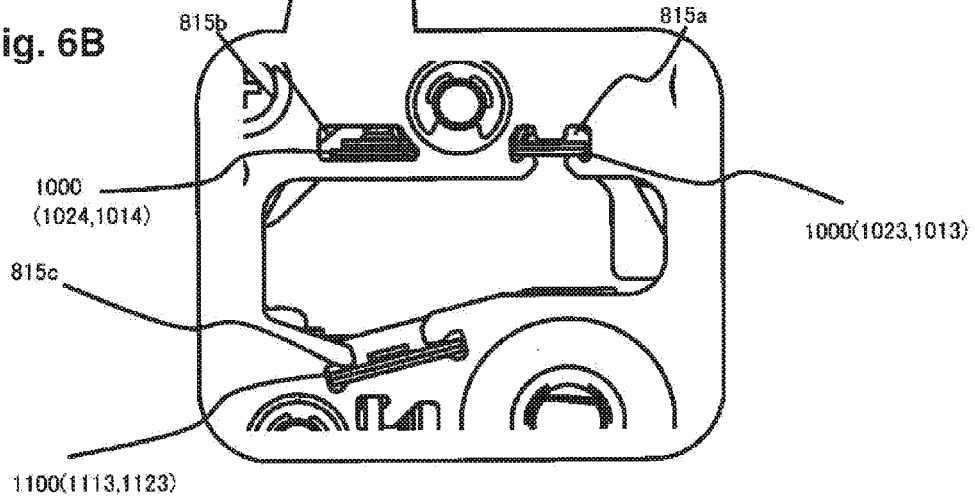
FIG. 6B is an enlarged view of part of FIG. 6A.

FIG. 6A is a side view of unit 81 (frame 815) when seen in the direction of arrow A1. FIG. 6B is an enlarged view of part (the portion surrounded by the dotted line of FIG. 6A) of unit 81 (frame 815). Also, FIG. 7 is a side view of unit 81 (frame 815) when seen in the direction of arrow A2.

Figure 8:
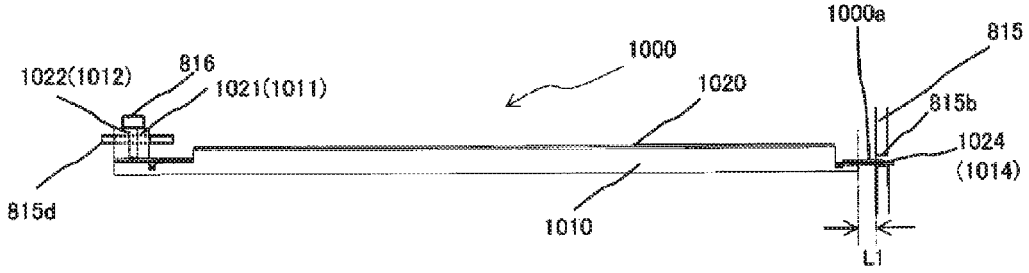
FIG. 8 is an explanatory diagram illustrating a configuration for mounting the first reflector unit according to the embodiment.
Figure 9:
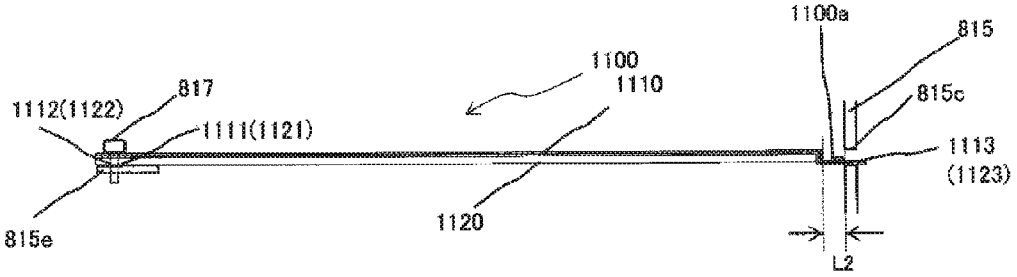
FIG. 9 is an explanatory diagram illustrating a configuration for mounting the second reflector unit according to the embodiment.

FIG. 8 is an explanatory diagram (conceptual diagram) illustrating the configuration for mounting reflector unit 1000 on frame 815. FIG. 9 is an explanatory diagram (conceptual diagram) illustrating the configuration for mounting reflector unit 1100 on frame 815. It is to be noted that FIG. 8 and FIG. 9 are diagrams when reflector units 1000, 1100 are viewed in the longitudinal direction (the direction of arrow A3 of FIG. 5). It is to be noted that FIG. 8 and FIG. 9 illustrate a state (a shape) of reflector units 1000, 1100 at a normal temperature (when halogen lamps 805, 806 are OFF).

Figure 7:
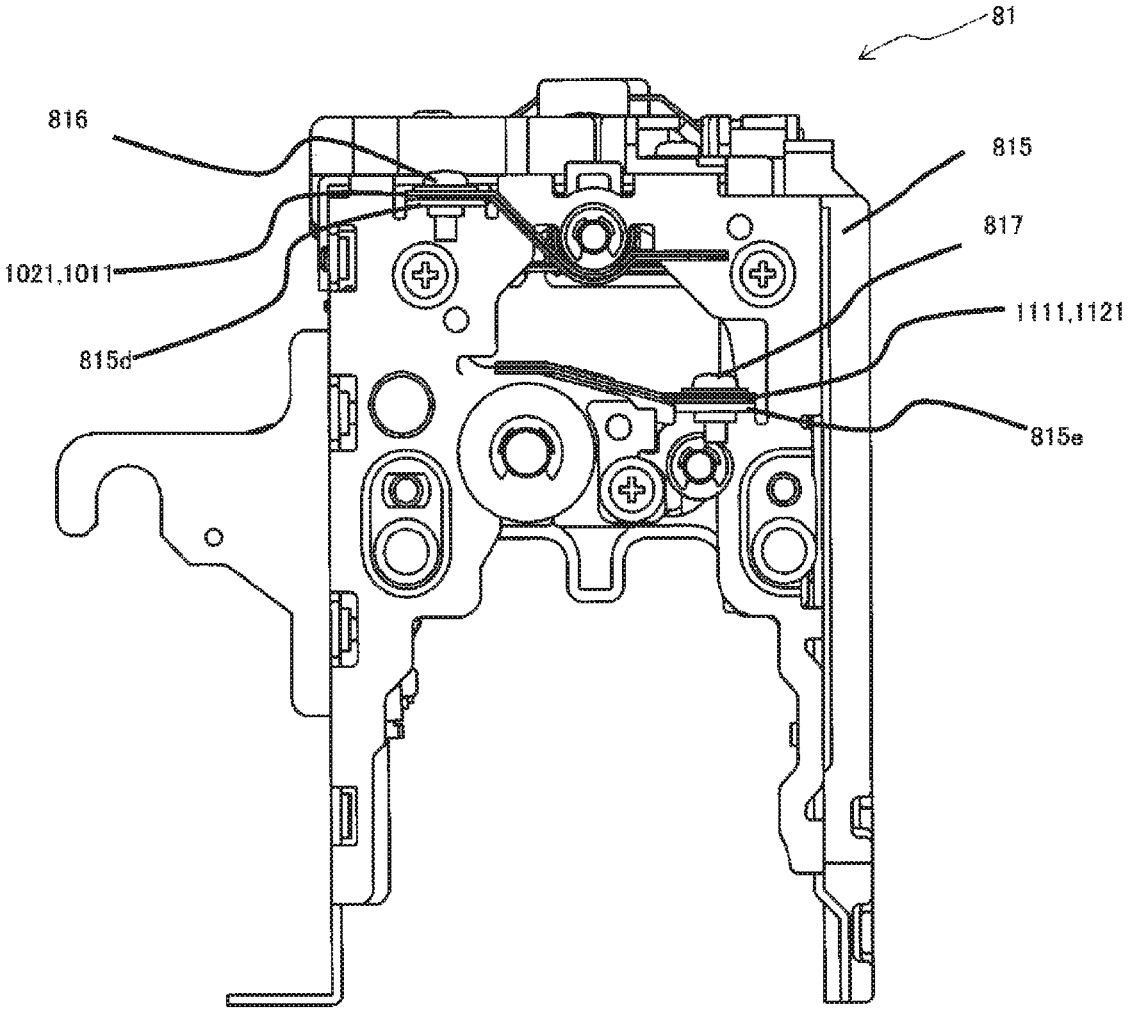
FIG. 7 is a side view (part 2) of the unit (frame) according to the embodiment.

As illustrated in FIG. 7 and FIG. 8, fixture portions 1011, 1021 formed at one end of reflector unit 1000 are fixed to supporter 815*d* (first supporter) of frame 815 by screw 816. In this case, screw 816 passes through screw holes 1012, 1022 provided in fixture portions 1011, 1021.

As illustrated in FIGS. 6A, 6B and FIG. 8, engagement portions 1013, 1023 formed at the other end of reflector unit 1000 are in a state of being inserted in mounting groove 815*a* (second supporter) provided in frame 815. That is, engagement portions 1013, 1023 are in a state of being supported by mounting groove 815*a*. Also, engagement portions 1014, 1024 formed in reflector unit 1000 are in a state of being inserted in mounting groove 815*b* provided in frame 815. That is, engagement portions 1014, 1024 are also in a state of being supported by mounting groove 815*b*.

It is to be noted that although FIG. 8 illustrates a state where engagement portions 1014, 1024 are through mounting groove 815*b*, engagement portions 1013, 1023 are similarly through mounting groove 815*b*.

As illustrated in FIG. 7 and FIG. 9, fixture portions 1111, 1121 formed at one end of reflector unit 1100 are fixed to supporter 815*e* of frame 815 by screw 817. In this case, screw 817 is through screw holes 1112, 1122 provided in fixture portions 1111, 1121.

As illustrated in FIGS. 6A, 6B and FIG. 9, engagement portions 1113, 1123 formed at the other end of reflector unit 1100 are in a state of being inserted in mounting groove 815*c* provided in frame 815. That is, engagement portions 1113, 1123 are in a state of being supported by mounting groove 815*c*.

As illustrated in FIGS. 6A, 6B and FIG. 8, in reflector unit 1000, engagement portions 1013, 1023 are through mounting groove 815*a* and engagement portions 1014, 1024 are through mounting groove 815*b*.

As illustrated in FIG. 8, at a normal temperature (when halogen lamps 805, 806 are OFF), in the inner side (the inner side of frame 815) of mounting groove 815*b*, engagement portions 1014, 1024 are assumed to be formed so that extra length portion 1000*a* having a length L1 in the longitudinal direction is created. In other words, length L1 of extra length portion 1000*a* is the width of the clearance between the inner side of frame 815 and the main body of reflector unit 1000. Although an illustration is omitted in FIG. 8, engagement portions 1013, 1023 are assumed to be similarly provided with extra length portion 1000*a* having length L1 in the longitudinal direction.

Although FIG. 8 illustrates a state of a normal temperature (when halogen lamps 805, 806 are OFF), when halogen lamps 805, 806 are turned ON and the temperature of reflector unit 1000 (reflector 1010, radiator 1020) increases, reflector unit 1000 (reflector 1010, radiator 1020) expands and primarily the dimension in the longitudinal direction increases. At this point, one end of reflector unit 1000 (reflector 1010, radiator 1020) is in a state of being inserted in mounting grooves 815*a*, 815*b* (a state where the position in the longitudinal direction is not regulated), and thus it is possible to suppress occurrence of bending and warpage of reflector unit 1000 (reflector 1010, radiator 1020) even when reflector unit 1000 is extended by at least length L1 of extra length portion 1000*a*. That is, length L1 of extra length portion 1000*a* at a normal temperature has to be a dimension determined by taking the expansion coefficient of reflector unit 1000 (reflector 1010, radiator 1020) into consideration. It is to be noted that although reflector unit 1000 is formed of reflector 1010 and radiator 1020 which are materials having different characteristics (such as different thermal expansion coefficients) to heat, individual expansion and contraction of reflector 1010 and radiator 1020 in a range of extra length portion 1000*a* do not interfere with each other.

As illustrated in FIG. 9, also on the side of reflector unit 1100, at a normal temperature (when halogen lamps 805, 806 are OFF), in the inner side (the inner side of frame 815) of mounting groove 815*c*, engagement portions 1113, 1123 are assumed to be formed so that extra length portion 1100*a* having a length L2 in the longitudinal direction is created. Extra length portion 1100*a* serves the same function (a buffer function in consideration of the thermal expansion of reflector unit 1100) as the above-described extra length portion 1000*a* does. It is to be noted that length L2 may be the same dimension as length L1.

(A-2) Effect of Embodiment

According to the embodiment, the following effects may be obtained.

In fixation device 8 of the embodiment, reflector units 1000, 1100 are provided with radiators 1020, 1120 for radiating the heat of reflectors 1010, 1110. This makes it possible to suppress an increase in the temperature of reflectors 1010, 1110, and to suppress a deterioration of the reflective performance of reflector units 1000, 1100.

In addition, fixation device 8 of the embodiment has a configuration in which one of the ends of reflector units 1000, 1100 are screwed and the other of the ends are inserted in the mounting grooves, and each engagement portion is provided with an extra length portion. Thus, in fixation device 8, occurrence of bending and warpage of reflector units 1000, 1100 due to thermal expansion or the like is suppressed.

Furthermore, in the embodiment, in reflector unit 1000, 1100, reflector 1010, 1110 and radiator 1020, 1120 are attached to each other without their contact surfaces bonded together. Thus, in reflector unit 1000, 1100, deformation and bending due to a difference between the expansion coefficients of reflector 1010, 1110 and radiator 1020, 1120 are suppressed. Also, reflector 1010, 1110 and radiator 1020, 1120 are attached to each other without their contact surfaces bonded together, and thus a certain amount of clearance (play) is formed between reflector 1010, 1110 and radiator 1020, 1120. Consequently, it is possible to absorb deformation of reflector 1010, 1110 and radiator 1020, 1120 that might occur due to heat and to suppress an overall change in the shape of reflector unit 1000, 1100.

(B) Other Embodiments

The invention is not limited to the above-described embodiment and modified embodiments as illustrated below may also be provided.

(B-1) In the above-described embodiment, although an example has been described where a continuous form paper wound in a roll is applied to the medium in image formation apparatus 100, the type (material and shape) of the medium in the fixation device and the image formation apparatus of the invention is not limited.

Also, in the above-described embodiment, although image formation apparatus 100 has been described as a color printer (in a configuration including image formation units corresponding to multiple toner colors), image formation apparatus 100 may be a monochrome printer (in a configuration including an image formation unit corresponding to only a single toner color). Furthermore, in image formation apparatus 100, the system by which a toner image is transferred to paper sheet P is not limited to the intermediate transfer belt system, and various other systems are applicable.

Furthermore, in the above-described embodiment, although an example has been described where the image formation apparatus and the fixation device of the invention are applied to a printer, the image formation apparatus and the fixation device may be applied to other image formation apparatuses (electrophotographic image formation apparatuses) such as a FAX and a copy machine.

(B-2) In fixation device 8 of the above-described embodiment, belt 802 on the lower side is also provided with halogen lamp 807. However, a configuration may be adopted in which halogen lamp 807 in belt 802 on the lower side is omitted.

Also, in the above-described embodiment, although a radiator is not disposed in reflector units 1200, 1300 which are disposed in belt 802 on the lower side, a configuration may be adopted in which a radiator is provided similarly to reflector units 1000, 1100.

(B-3) In the fixation device of the invention, the number and shapes of radiator plates disposed are not limited.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A fixation device comprising:

a fixation belt;

a heat source that heats the fixation belt; and a reflector unit that reflects heat from the heat source to the belt, wherein the reflector unit includes a reflective member that reflects the heat from the heat source, and a radiation member that is disposed on an opposite side to a side of the reflective member facing the heat source, and that radiates heat of the reflective member.

2. The fixation device according to claim 1, wherein the radiation member is formed of a material having a higher melting point than the reflective member.

3. The fixation device according to claim 1, further comprising a frame including a first supporter that supports one longitudinal end of the reflector unit, and a second supporter that supports the other longitudinal end of the reflector unit.

4. The fixation device according to claim 3, wherein the second supporter of the frame comprises a mounting groove that allows the other longitudinal end of the reflector unit to pass through.

5. The fixation device according to claim 3, wherein the one end of the reflector unit in the longitudinal direction is fixed to the first supporter.

6. The fixation device according to claim 3, wherein the one end of the reflector unit in the longitudinal direction includes an engagement portion that is engaged with the frame in a state where the other end of the reflector unit in the longitudinal direction is through the mounting groove of the frame.

7. The fixation device according to claim 6, wherein the engagement portion is provided with an extra length portion with a predetermined length in the longitudinal direction in an inner side of the frame.

8. The fixation device according to claim 1, wherein at least one longitudinal end of the reflective member and at least one longitudinal end of the radiation member respectively include engagement portions to be engaged with each other.

9. The fixation device according to claim 8, wherein one side of the reflective member and one side of the radiation member are in substantially the same shape and are in contact with each other over their entire sides.

10. The fixation device according to claim 1, further comprising a frame, wherein longitudinal ends of the reflective member and longitudinal ends of the radiation member are stacked on each other and the stacked longitudinal ends are engaged with or fixed to the frame.

11. The fixation device according to claim 1, wherein the reflective member and the radiation member are stacked on each other without an adhesive therebetween.

12. The fixation device according to claim 1, wherein the radiation member has a higher stiffness and a higher melting point temperature than the reflective member.

13. An image formation apparatus comprising the fixation device according to claim 1 that fixes a development agent image formed on a medium.

* * * * *